US005448903A

United States Patent [19]

Johnson

[11] Patent Number: 5,448,903

[45] Date of Patent: Sep. 12, 1995

[54] METHOD FOR NECKING A METAL CONTAINER BODY

[75] Inventor: Dean Johnson, Littleton, Colo.

[73] Assignee: Ball Corporation, Muncie, Ind.

[21] Appl. No.: 186,760

[22] Filed: Jan. 25, 1994

[51] Int. Cl.[6] ..... B21C 37/02; B21D 22/00

[52] U.S. Cl. ..... 72/94; 72/379.4; 72/352

[58] Field of Search ..... 72/110, 106, 105, 94, 72/352, 379.4; 413/69

[56] References Cited

U.S. PATENT DOCUMENTS

| | | | |
|---|---|---|---|
| 3,688,538 | 9/1972 | Hoyne | 72/94 |
| 4,070,888 | 1/1978 | Gombas | 72/91 |
| 4,173,883 | 11/1979 | Boik | 72/354 |
| 4,403,493 | 9/1983 | Atkinson | 72/356 |
| 4,457,158 | 7/1984 | Miller et al. | 72/354 |
| 4,512,172 | 4/1985 | Abbott et al. | 72/68 |
| 4,519,232 | 5/1985 | Traczyk et al. | 72/133 |
| 4,563,887 | 1/1986 | Bressan et al. | 72/84 |
| 4,578,007 | 3/1986 | Diekhoff | 413/6 |
| 4,693,108 | 9/1987 | Traczyk et al. | 72/370 |
| 4,732,027 | 3/1988 | Traczyk et al. | 72/133 |
| 4,781,047 | 11/1988 | Bressan et al. | 72/84 |
| 5,138,858 | 8/1992 | Johnson et al. | 72/68 |

*Primary Examiner*—Lowell A. Larson
*Assistant Examiner*—Rodney A. Butler
*Attorney, Agent, or Firm*—Gilbert E. Alberding

[57] ABSTRACT

The method for necking a metal container body comprises the steps of reducing a first portion of the sidewall of the container body to a first necked diameter, applying force to create tension in at least a portion of a second portion of the sidewall, and further reducing the first portion of the container body to a second necked diameter, during at least a portion of the applying step, by effecting relative motion between the container body and an external forming member. The step of applying a force to create tension in the sidewall may comprise radially displacing at least part of the shoulder portion outwardly away from the central longitudinal axis. Such radial displacement may entail positioning a first rotatable support member inside the container body with a forming radius of the support member longitudinally positioned to be misaligned with the shoulder radius of the container body, and moving the support member radially outwardly away from the central longitudinal axis until at least a portion of the shoulder portion is displaced radially outwardly.

16 Claims, 6 Drawing Sheets

METHOD FOR NECKING A METAL CONTAINER BODY

FIELD OF THE INVENTION

The present invention generally relates to the processing of metal container bodies and, more particularly, to a novel method for necking an open end of a metal container body which improves the overall necking process by decreasing the failure rate of container bodies due to krinkling and due to sidewall buckling.

BACKGROUND OF THE INVENTION

In the container-making industry, containers are typically manufactured in at least two parts: a container body and at least one container end. The container body may be drawn and ironed such that only a single container end is required (two-piece container) or the container body may be formed by rolling a stamped sheet into cylindrical form and welding the seam such that two container ends are required (three-piece container). Regardless of the particular container structure, after the container is filled, container ends are typically double-seamed to the open end. More recently, the open end of metal containers has been necked prior to end piece connection. By reducing the diameter at the open end of the container body, the amount of end piece material can be decreased to lower packaging costs, and containers can be stacked more readily to accommodate storage, handling and display.

Numerous techniques for necking the open end of a container body have been developed. Such techniques generally entail the use of external dies and/or rollers which act upon the outside of a container body. As used herein, a "die-necking" operation is an operation wherein a cylindrical container body and inward reducing die are axially aligned and opposingly advanced to force an open end of the container body through the reducing die. Due to the high compressive forces imparted to the container bodies in die-necking operations, only a relatively small reduction in diameter per operation can be achieved without sidewall buckling or crumpling. As such, several successive die-necking operations are often necessary to achieve a desired diameter reduction.

In necking processes utilizing external rollers, one or more rollers contact the sidewall of a rotating container body near an open end thereof and are driven radially inward. A cylindrical member is internally and rotatably disposed at the open end of the container body to support the open end during such processes. In some known processes, no internal support is provided in opposing relation to the inward progression of an external forming roller, thereby resulting in process control problems which, in practice, limit the degree of inward necking. Further, in such known roll-forming processes, the configuration and relative positioning of the external roller and interfacing cylindrical member cause the open end of the container body to be drawn through an extremely sharp radius therebetween (i.e., approaching a 90° bend) to form a finished flange and generate a risk that metal slivers will be created within the container body. Such contemporaneous flange forming and production risk also limit, in practice, the degree of realizable inward necking.

Recently, a novel necking technique, known as "spin-flow forming" and described in U.S. Pat. Nos. 4,563,887 and 4,781,047, has been developed in which two internal members are provided to support and thereby control a rotating container body as an opposing external roller progresses radially inwardly and axially to neck the container, thereby allowing for significant increase in the degree of inward necking that, in practice, can be realized in a single process step. More recently, it was discovered that substantial benefits could be realized by the combinative use of die-necking and spin-flow forming operations. By die-necking prior to spin-flow forming, plug diameter variations in container bodies are substantially reduced prior to spin-flow forming, thereby reducing the likelihood of container body failure during spin-flow forming operations and increasing container uniformity upon spin-flow forming. Such combinative use of die-necking and spin-flow forming operations is disclosed in U.S. Pat. No. 5,138,858.

While the combinative utilization of die-necking and spin-flow forming has reduced the likelihood of container body failure during spin-flow forming operations and has increased container uniformity, container bodies undergoing spin-flow forming are still susceptible to "krinkling" failure under certain situations. Krinkling is caused by torsional forces on the container body (e.g., the container sidewall) exceeding the torsional strength thereof. A krinkling failure typically manifests itself as a "z-shaped" nonuniformity in the sidewall of the container body immediately below the shoulder radius. Such failures due to krinkling have become increasingly problematic with decreasing container sidewall thicknesses and increasing production speeds.

Consequently, it is an object of the present invention to increase the efficiency of the spin-flow forming operation. It is a related object of the present invention to improve the spin-flow forming process by decreasing the occurrence of sidewall failure due to krinkling and/or by allowing increased production speeds.

SUMMARY OF THE INVENTION

The present invention is embodied in a method for necking a cylindrical metal container body having a sidewall with a plug diameter. The method is initiated by reducing a portion of the container sidewall to a first necked diameter to thereby form a sidewall having a shoulder portion connecting an unreduced portion to the reduced portion. Such reduction serves to reduce plug diameter variations in the container bodies (e.g., for a plurality of container bodies from the same bodymaker and, more importantly, from different bodymakers), thereby reducing the likelihood of container body failure during subsequent forming operations. The method further includes applying a force to tension at least a portion of the unreduced sidewall and, during at least a portion of the step of applying a force to create tension, further reducing at least a portion of the reduced portion to a second necked diameter by effecting relative motion between the container body and an external forming member. As set forth in more detail below, it is believed that such tension in the unreduced portion of the sidewall reduces the likelihood for sidewall failure (i.e., in the unreduced portion during subsequent forming operations and in the final product) and improves shoulder radius appearance.

In one embodiment, the step of reducing a portion of the container sidewall to a first necked diameter comprises performing at least one die-necking operation, and preferably comprises three such die-necking operations. The die-necking operation may include the steps of axially aligning an open end of the container body with a die set having an external necking die and an opposing internal pilot, and forcing the open end of the container body between the external necking die and the opposing internal pilot to reduce the diameter of the open end and to form a sidewall having a shoulder portion connecting the unreduced portion to the reduced portion. When utilizing three die-necking operations, each operation further reduces the open end of the container body until the desired first necked diameter is obtained.

The shoulder portion formed by the above-referenced reducing step preferably includes an externally convex shoulder radius longitudinally positioned at a first longitudinal distance from a bottom of the container. In this regard, the step of applying a force to tension at least a portion of the sidewall may comprise radially displacing at least part of the shoulder portion outwardly away from the central longitudinal axis. For example, such radial displacement may comprise the steps of positioning a first rotatable support member inside the container body with a forming radius of the support member longitudinally positioned at a second longitudinal distance from the container bottom, and advancing the first support member radially outwardly away from the central longitudinal axis until at least a portion of the shoulder portion is displaced radially outwardly. In this embodiment, the second longitudinal distance is greater than the first longitudinal distance.

The first support member may be eccentrically rotatably mounted to an eccentric shaft which is rotatable about its own central axis. The eccentric shaft may further be eccentrically positioned relative to the central longitudinal axis of the container body such that the eccentric shaft may be rotated to move the first support member from a position aligned with the central longitudinal axis to a positioned misaligned therewith.

It should be appreciated that the desired difference between the second longitudinal distance and the first longitudinal distance will depend on a number of factors. For example, such factors include sidewall material thickness, rotational speed of container, rate of reduction (i.e., speed of deformation), form roll radii, as well as other variables. For a sidewall material thickness of between about 0.0035 inches and about 0.0045 inches, it has been found that such difference is preferably between about 0.010 inches and about 150 inches. More preferably, such difference is between about 0.050 inches and about 0.110 inches and, most preferably, such difference is about 0.080 inches.

In another embodiment, the step of further reducing the reduced portion of the sidewall comprises performing a spinflow necking operation on the container body to reduce the reduced portion from the first necked diameter to the second necked diameter. Preferably, such step of performing a spinflow necking operation comprises positioning a first rotatable support member inside the container body, positioning a second rotatable support member inside the container body adjacent the open end, radially advancing an external roller inwardly toward the central longitudinal axis, and continuing to radially advance the external roller inward toward the central longitudinal axis. Such continued radial advancement results in an angled first face of the external roller camming radially and axially against a complementarily angled face of the first support member toward the open end to reduce the first necked diameter of the open end to the second necked diameter.

In addition to reducing the open end of the container body, the step of continuing to radially advance the external roller may also reform at least a portion of the shoulder portion. Preferably, such reformation of at least a portion of the shoulder portion also reforms the radius to a reformed radius smaller than the original shoulder radius of the die-necked container body.

By virtue of the above-described invention, an improved process for necking a metal container body is provided. More specifically, it has been found that container bodies necked according to such a process have enhanced resistance to failing due to krinkling and/or buckling of the sidewall. In addition, the process can produce container bodies having improved shoulder radius appearance.

DETAILED DESCRIPTION

Figure 1:
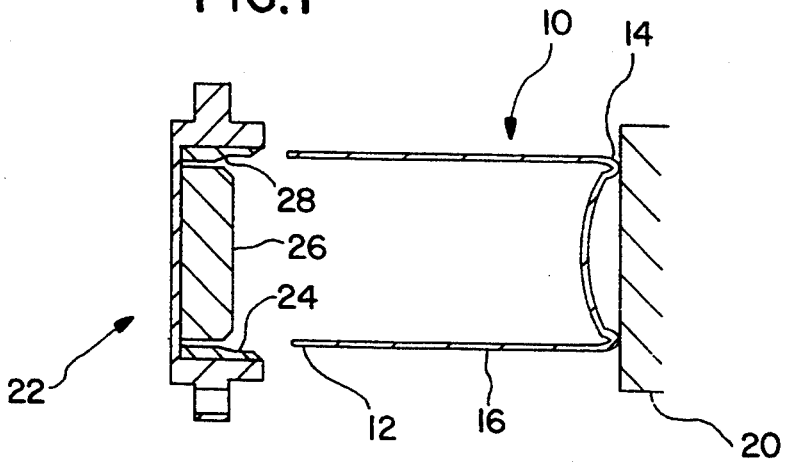
FIG. 1 is a longitudinal section view of a die-necking apparatus immediately prior to the die-necking operation.
Figure 2:
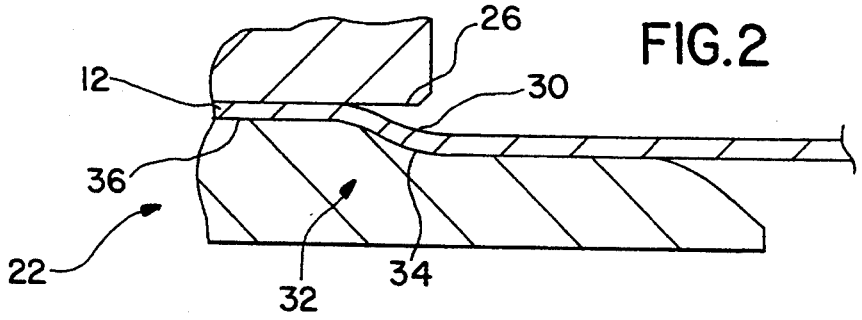
FIG. 2 is an enlarged section view of the container body and the first necking die immediately after the first die-necking operation.

The Figures generally illustrate one embodiment of the present invention. In the illustrated embodiment, the open end 12 of a container body 10 is reduced to a first necked diameter by a three-stage die-necking operation (FIGS. 1–4) and is further reduced to a second necked diameter utilizing an "interference" spin-flow forming operation (FIGS. 6–9) o Referring to FIG. 1, in performing the die-necking operation, the container body 10 is positioned on a bottom support 20 and the open end 12 of the container body 10 is axially aligned with a first die set 22 comprising an external die member 24 and cylindrical internal pilot 26. The die set 22 is then axially driven toward the container body 10 to force the open end 12 of the container body 10 into the space 28 between the external die member 24 and the internal pilot 26. More particularly, referring to FIG. 2, the open end 12 of the container body 10 contacts the angled forming surface 30 of the external die member 24 and is guided toward the internal pilot 26. The open end 12 subsequently contacts the internal pilot 26 and is guided into the space 28 between the external die member 24 and the internal pilot 26, thereby forming a shoulder portion 32 having a shoulder radius 34 and a cylindrical portion 36 adjacent to the open end 12 thereof having a first necked diameter. The axial positioning of the shoulder radius 34 relative to the container bottom 14 is controlled by controlling the axial distance of the die set 22 from the bottom support 20 at the end of the first stage die-necking operation.

Figure 3:
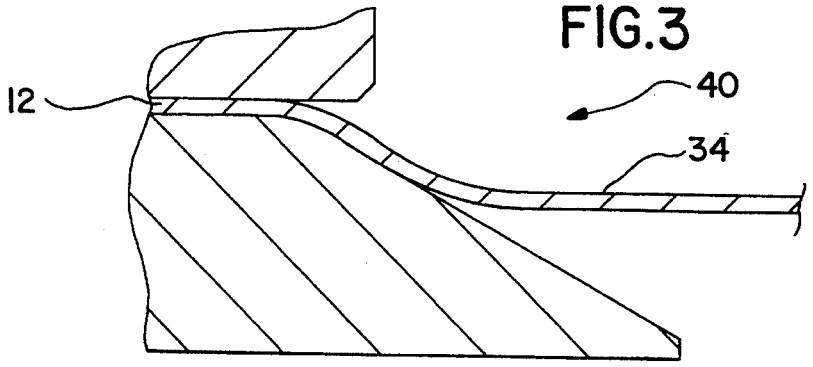
FIG. 3 is an enlarged section view of the container body and the second necking die immediately after the second die-necking operation.
Figure 4:
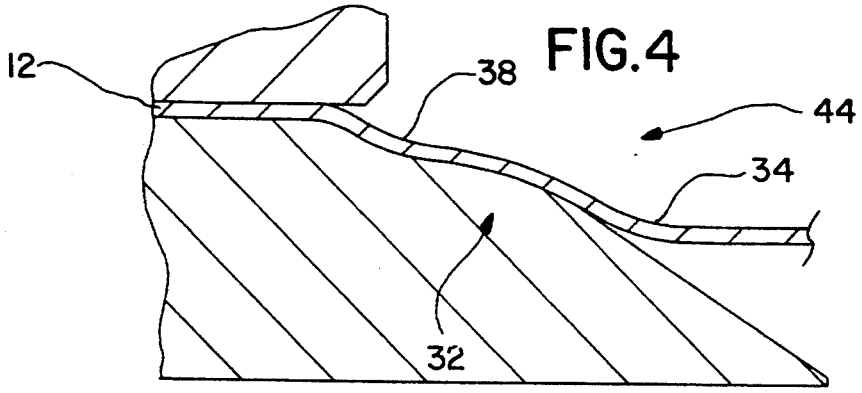
FIG. 4 is an enlarged section view of the container body and third necking die immediately after the third die-necking operation.

FIGS. 3 and 4 illustrate the second and third stages of the die-necking operation, respectively. Such second and third stage operations are performed in a manner substantially similar to the first stage operation (i.e., axial alignment followed by relative axial movement) except that they utilize a second die set 40 and a third die set 44, respectively. The second-stage of the die-necking operation further reduces the diameter of the open end 12 to yet a smaller diameter, but does not substantially alter the positioning of the shoulder radius 34 relative to the container bottom 14. Similarly, the third-stage of the die-necking operation further reduces the diameter of the open end 12 of the container body 10, but does not substantially alter the position of the shoulder radius 34. In addition, the third-stage forms a secondary shoulder radius 38 above (i.e., closer to the open end 12 relative to) the shoulder radius 34 formed during the first-stage, thereby forming a shoulder portion 32 having a "stepped" configuration.

Figure 5:
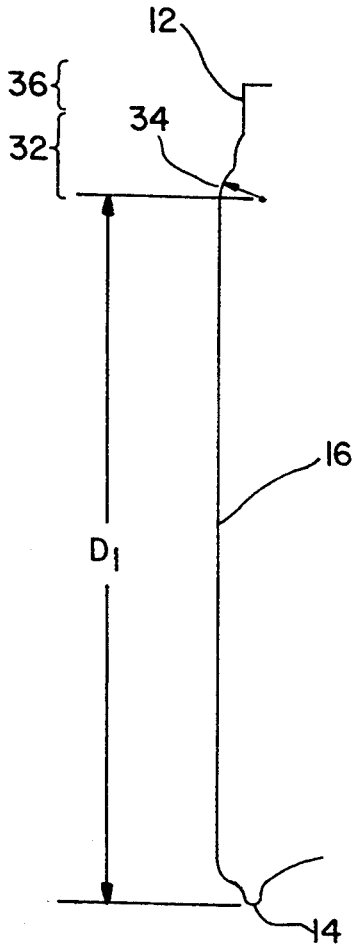
FIG. 5 is an outline of a portion of a container body after the three-stage die-necking operation.

The above-described three-stage die-necking operation produces a container body 10 having a configuration similar to that shown in FIG. 5. In this regard, the axial distance $D_1$ of the center of the shoulder radius 34 to the bottom of the container is important in that it determines the appropriate positioning of the spin-flow forming apparatus 50 in order to properly perform the interference spin-flow forming operation of the present invention. More specifically, the distance D1 should be slightly less than the desired axial distance from the container bottom 14 to the final shoulder radius 140 (FIG. 9*b*) in the final container body 10, the benefit of such difference (i.e., the "interference") being described herein in more detail.

It should be appreciated that the above-described die-necking operation could be substituted with any appropriate can forming operation which reduces the diameter of the open end 12 of the container body 10 and thereby forms a shoulder portion 32 having a shoulder radius 34. Furthermore, it should be appreciated that the shoulder portion 32 could continue from the shoulder radius 34 all the way to the open end 12 of the container body 10 without a cylindrical portion 36 adjacent the open end 12 thereof. Additionally, the shoulder portion 32 need not be of a stepped configuration, but could instead comprise other shapes such as a smooth shoulder configuration.

Figure 6A:
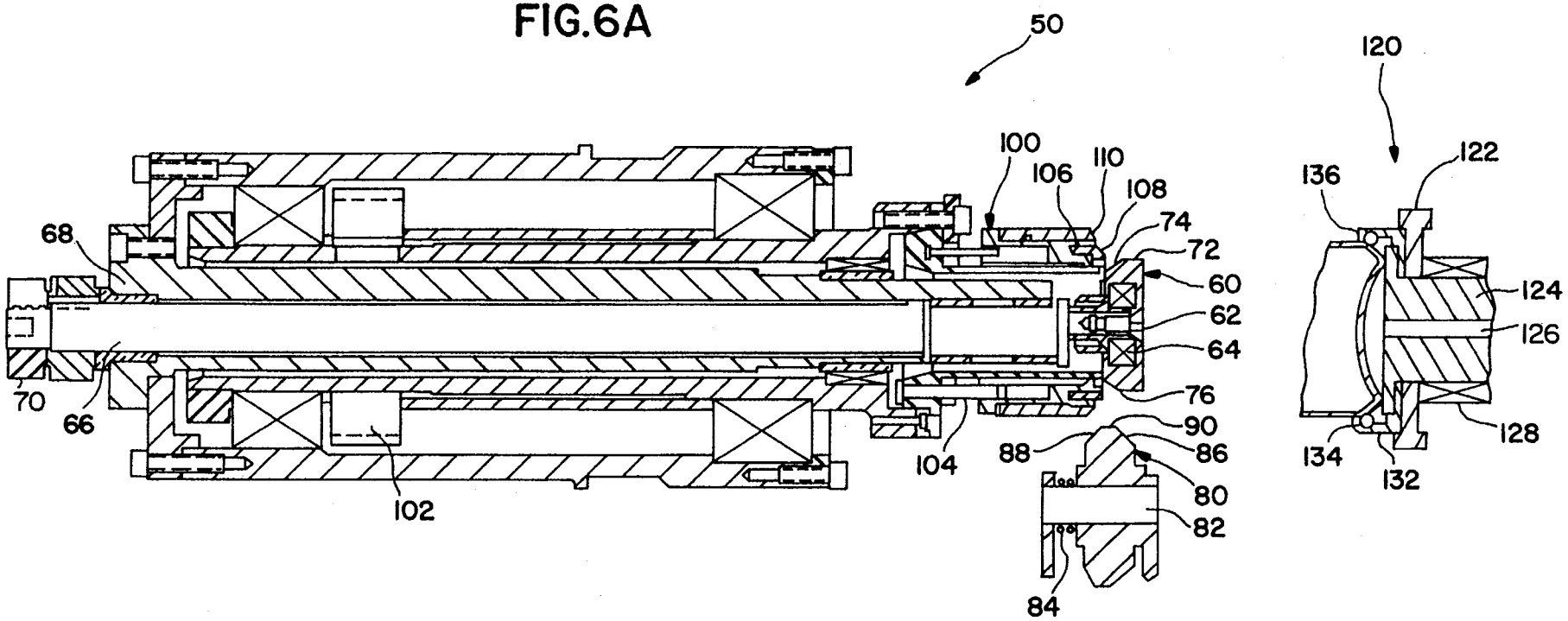
FIG. 6*a* is a longitudinal section view of a spin-flow forming apparatus embodying the present invention showing the eccentric roll in the aligned position.
Figure 6B:
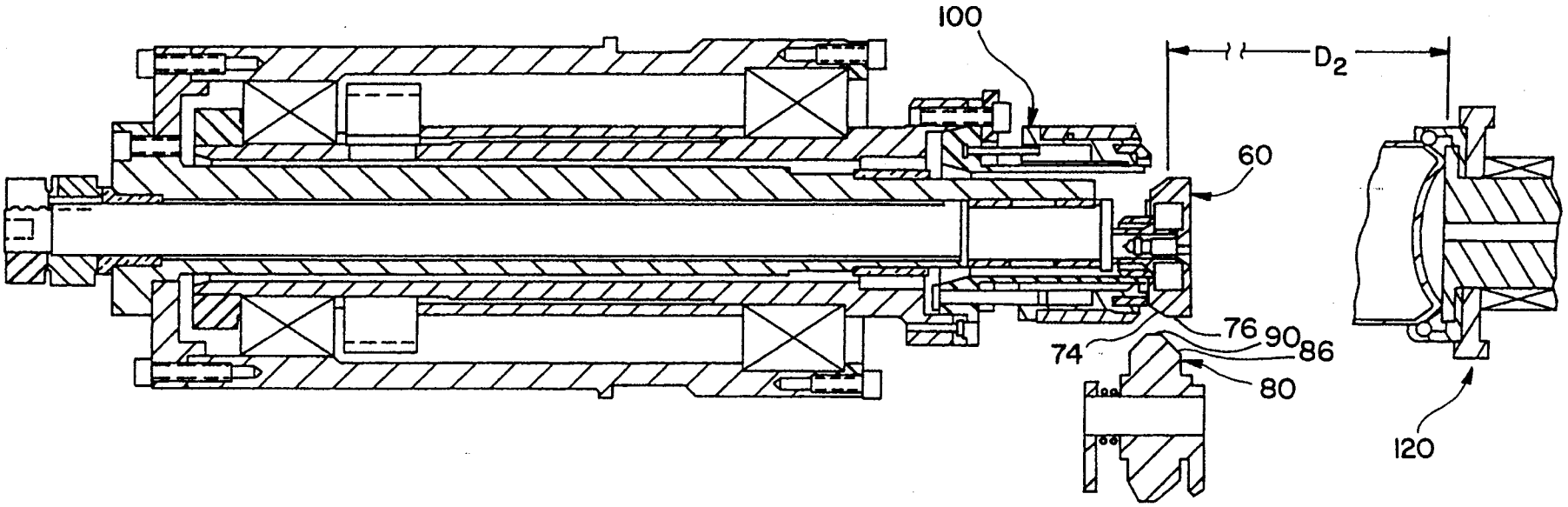
FIG. 6*b* is the section view of FIG. 6*a* with the eccentric roll in the misaligned position.

The interference spin-flow forming operation of the described embodiment is performed utilizing a spin-flow forming apparatus 50 as shown in FIGS. 6*a*–6*b*. Such spin-flow forming apparatus 50 is disclosed in detail in U.S. Pat. Nos. 4,563,887, 4,781,047 and 5,138,858, which are hereby incorporated by reference in their entireties.

The spin-flow forming apparatus 50 of the illustrated embodiment generally comprises three forming rolls: an internal eccentric roll 60, an external form roll 80, and an internal slide roll 100. Each forming roll is appropriately mounted and positioned relative to the other rolls to facilitate performance of the spin-flow forming operation, as described below in more detail.

Figure 7:
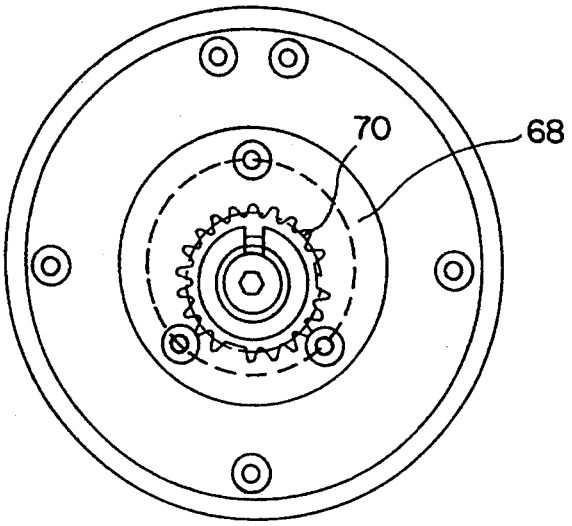
FIG. 7 is an end view of the spin-flow forming apparatus shown in FIGS. 6*a* and 6*b;*

The eccentric roll 60 is rotatably mounted and axially fixed on an eccentric spindle 62 through appropriately positioned bearings 64. The eccentric spindle 62 is rigidly secured to an eccentric shaft 66 such that the center of the spindle is offset from the center of the shaft by about 0.150 inches (about 3.81 mm). The eccentric shaft 66 is rotatably positioned within a stationary support shaft 68 such that the center axis of the eccentric shaft 66 is offset from the center axis of the support shaft 68 by about 0.150 inches (about 3.81 mm). Utilizing such a configuration of offset shafts and spindles, the eccentric roll 60 can be rotated from an aligned position (FIG. 6*a*), wherein the center axis of the eccentric roll 60 is substantially aligned with the center axis of the support shaft 68, and a misaligned position (FIG. 6*b*), wherein the center axis of the eccentric roll 60 is misaligned with the center axis of the support shaft 68 by about 0.300 inches (about 7.62 mm). Such movement from the aligned position to the misaligned position is accomplished by rotating the eccentric shaft 66 about 180°. In the described embodiment, such rotation of the eccentric shaft 66 is accomplished by engagement and rotation of a gear 70 secured to one end of the eccentric shaft 66 (FIG. 7).

The eccentric roll 60 includes a cylindrical portion 72 and an inwardly converging angled portion 74. The dimensions of the eccentric roll 60 are such that the roll appropriately supports the inside of a container body 10 during the spinflow forming operation to thereby form a shoulder radius 34 in the container body 10. In this regard, the cylindrical portion 72 of the eccentric roll 60 of the described embodiment is about 2.000 inches (about 50.8 mm) in diameter such that, when the eccentric roll 60 is moved from the aligned position to the misaligned position, the cylindrical portion 72 of the eccentric roll 60 is appropriately positioned to support the sidewall 16 of a container body 10 having a diameter of about 2.60 inches (about 66.0 mm). That is, the misalignment of 0.30 inches (7.62 mm) plus the radius of the eccentric roll 60 of 1.00 inches (25.4 mm) is approximately equal to the radius of a container body sidewall 16 (i.e., about 1.30 inches (about 33.0 mm)). The cylindrical portion 72 of the eccentric roll 60 is joined with the angled portion 74 via a shoulder-forming radius 76 of about 0.150 inches (about 3.81 mm).

The external form roll 80 is appropriately mounted to a form spindle 82 such that the form roll 80 is rotatable and axially slidable relative to the form spindle 82. A compression spring 84 is appropriately positioned to axially bias the form roll 80 toward the end of the form spindle 82 (i.e., to the right in FIGS. 6*a* and 6*b*), without affecting the free rotatability of the form roll 80 relative to the form spindle 82.

The form roll 80 is dimensioned to have a first angled portion 86 interconnected with a second angled portion 88 via a neck-forming radius 90. The first angled portion 86 has an angle approximately equal to the angled portion 74 of the eccentric roll 60. In the described embodiment such angle is about 30° (i.e. from a longitudinal axis. The neck-forming radius 90 in the illustrated embodiment actually comprises multiple radii ranging from about 0.090 inches (about 2.29 mm) to about 0.200 inches (about 5.08 mm).

The form spindle 82 is movable radially toward the eccentric roll 60 such that the form roll 80 interacts with the eccentric roll 60. More specifically, the form roll 80 is positionable with the neck-forming radius 90 of the form roll 80 adjacent the shoulder-forming radius 76 of the eccentric roll 60, as shown in FIG. 6*b*. The form roll 80 is movable axially relative to the eccentric roll 60 such that the first angled portion 86 of the form roll 80 contacts the angled portion 74 of the eccentric roll 60 (i.e., with the container sidewall 16 therebetween). Further axial movement of the form roll 80 relative to the eccentric roll 60 causes the first angled portion 86 of the form roll 80 to cam off of the angled portion 74 of the eccentric roll 60, thereby causing the form roll 80 to slide axially on the form spindle 82, as described below in more detail.

The slide roll 100 of the described embodiment is rotatable and axially slidable relative to the stationary support shaft 68. The slide roll 100 is rotatably drivable through a gear 102 and is axially biased toward the eccentric roll 60 via a plurality of compression springs 104. The slide roll 100 is dimensioned to have a generally cylindrical portion 106 having a diameter appropriately sized to support the open end 12 of the container body 10 being necked. In the present embodiment, such diameter is about 2.260 inches (about 57.4 mm). The slide roll 100 further incudes an angled portion 108 appropriately dimensioned to approximately match the angle of the second angled portion 88 of the form roll 80. In the illustrated embodiment, such angle is about 60°.

The slide roll 100 further includes a cam ring 110 positioned radially outward from the angled portion 108 and slightly misaligned therewith. The cam ring 110 is angled to be approximately parallel with the angled portion 108 (i.e., about 60° in the described embodiment) but extends about 0.007 inches axially outward from being aligned with the angled portion 108, thereby providing a surface upon which the slide roll 100 cams off of the form roll 80, as described below in more detail.

The spin-flow forming apparatus 50 further includes a base pad assembly 120 which includes a chuck gear 122 driven at the same speed and in a manner similar to that used to drive the slide roll 100. The chuck gear 122 has a center hub 124 which is provided with an axially-extending vacuum passage 126 to permit vacuum to pass therethrough for purposes of holding the container bottom 14. The center hub 124 is rotatably supported on a bearing 128 whereby the chuck gear 122 can rotate when driven about its center axis. A cup 132 is mounted to the face of the chuck gear 122 and extends axially outwardly therefrom toward the forming rolls. The cup 132 is designed to carry an o-ring 134 within an inwardly rolled end 136 thereof in order to define a location against which the container bottom 14 can be sealed in order to maintain a vacuum established through the center hub 124.

The spin-flow forming operation is initiated by positioning a container in the cup 132 of the base pad assembly 120. Typically, the base pad assembly 120 is already spinning prior to loading of the container bottom 14 thereon, in which case the container will be accelerated to a spinning state upon contact with the o-ring 134 of the base pad assembly 120. With the eccentric roll 60 aligned with the slide roll 100 (FIG. 6*a*), the slide roll 100 and base pad assembly 120 are moved axially relative to each other until the eccentric and slide rolls 60,100 are positioned within the open end 12 of the container.

It should be appreciated that, instead of spinning the container and holding the eccentric and form rolls 60,80 stationary, the container could be stationary and the rolls 60,80 could be rotated (i.e., in an orbital path) around the container. That is, the important feature is that there is relative rotation between the container and the rolls, regardless of which is rotating.

The axial positioning of the eccentric roll 60 relative to the base pad assembly 120 is important in that it determines the location of the final shoulder radius 140 relative to the container bottom 14 on the finished container. In this regard, one would think, and the prior art has taught, that the eccentric roll 60 should be axially positioned such that the shoulder-forming radius 76 of the eccentric roll 60 is aligned with the shoulder radius 34 of the die-necked container body 10 presented to the spin-flow forming apparatus 50 (an "aligned" spin-flow forming operation). In other words, the axial distance $D_2$ from the container bottom 14 to the shoulder-forming radius 76 of the eccentric roll 60 (see FIG. 6*b*) is approximately equal to the axial distance $D_1$ (see FIG. 5).

Figure 8A:
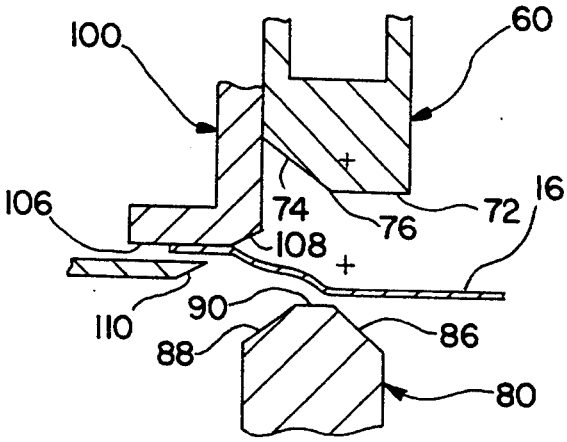
FIG. 8*a* is an enlarged section view of the spin-flow forming apparatus with the eccentric roll in the aligned position.
Figure 8B:
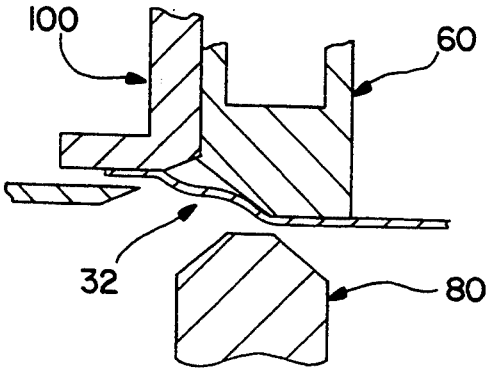
FIG. 8*b* is the section view of FIG. 8*a* with the eccentric roll in the misaligned position.
Figure 8C:
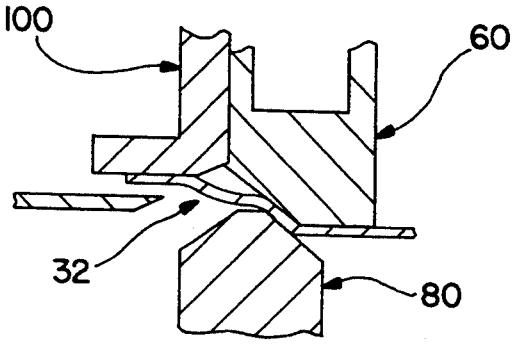
FIG. 8*c* is the section view of FIG. 8*a* with the form roll initiating engagement with the container body.
Figure 8D:
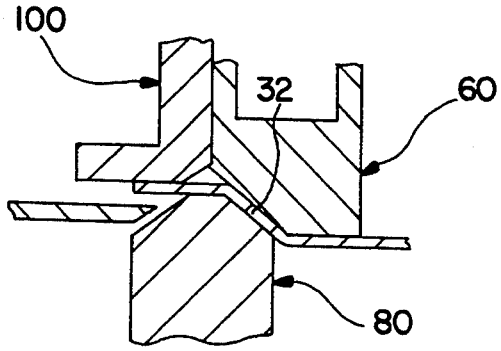
FIG. 8*d* is the section view of FIG. 8*a* with the form roll camming off of the frustoconical portion of the eccentric roll.
Figure 8E:
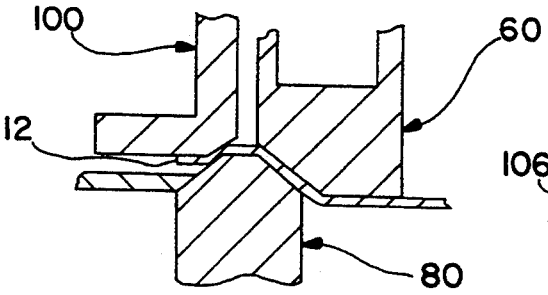
FIG. 8*e* is the section view of FIG. 8*a* with the form roll camming off of the cam ring of the slide roll.
Figure 8F:
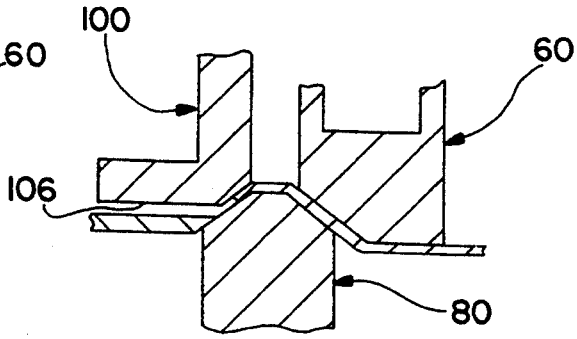
FIG. 8*f* is the section view of FIG. 8*a* with the form roll fully radially displaced.

In such an "aligned" spin-flow forming operation, once the eccentric roll 60 is properly positioned within the open end 12 of the container (FIG. 8*a*), the eccentric shaft 66 is rotated 180° such that the shoulder-forming radius 76 of the eccentric roll 60 is moved into position adjacent the container body 10 to provide support to the shoulder radius 34 of the die-necked container body 10 (FIG. 8*b*). The form roll 80 is subsequently moved radially inward until the form roll 80 contacts the shoulder portion 32 of the container body 10 (FIG. 8*c*). Subsequent radially inward movement of the form roll 80 causes the form roll 80 to cam off of the angled portion 74 of the eccentric roll 60 (i.e., with the container body 10 therebetween) to further inwardly deform the shoulder portion 32 of the container body 10 (FIG. 8*d*). Such camming action forces the form roll 80 to move axially against the spring force applied thereto as it is driven further radially inward. As such camming action progresses, the second angled surface 88 of the form roll 80 interfaces with the cam ring 110. Such interface forces the slide roll 100 to move axially against the spring force applied thereto as the form roll 80 progresses radially and axially (FIG. 8*e*). Further radial and axial movement of the form roll 80 continues until the open end 12 of the container slips off of the cylindrical portion 106 of the slide roll 100 and is pinched between the angled surface 108 of the slide roll 100 and the second angled surface 88 of the form roll 80 (FIG. 8*f*). It is at this point (i.e., when the open end 12 of the container slides off of the cylindrical portion 106 of the slide roll 100) that krinkling of the container sidewall 16 is most likely to occur due to loss of control of the open end 12 of the container.

Figure 9A:
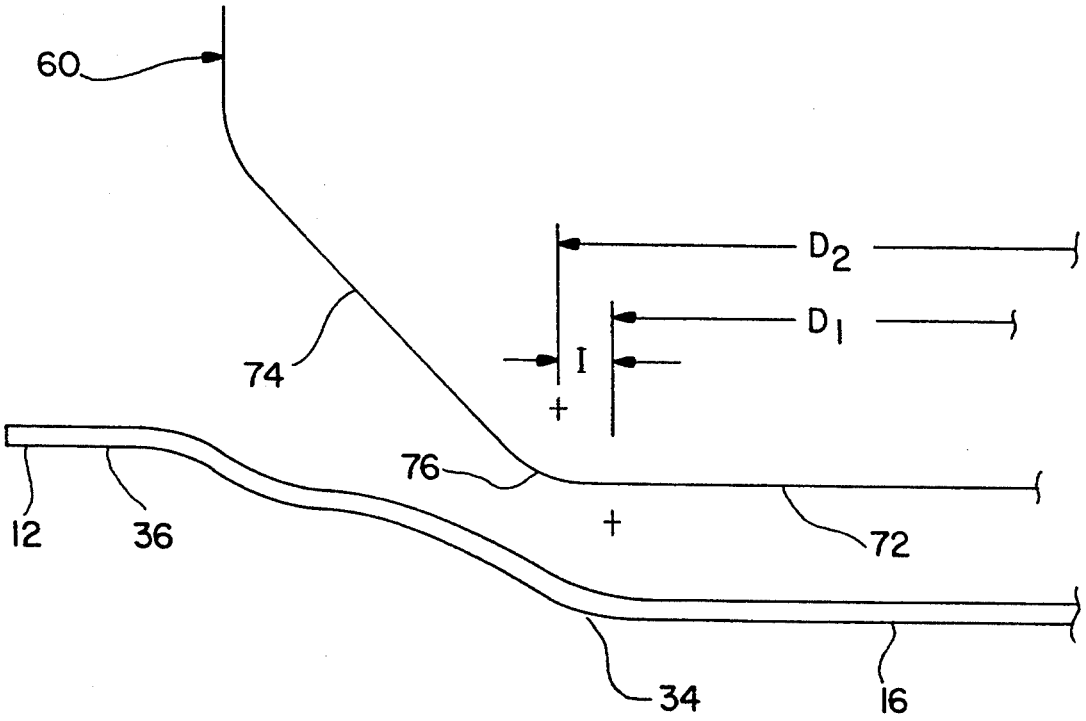
FIG. 9*a* is an enlarged section view of an interference spin-flow forming operation with the eccentric roll in the aligned position.
Figure 9B:
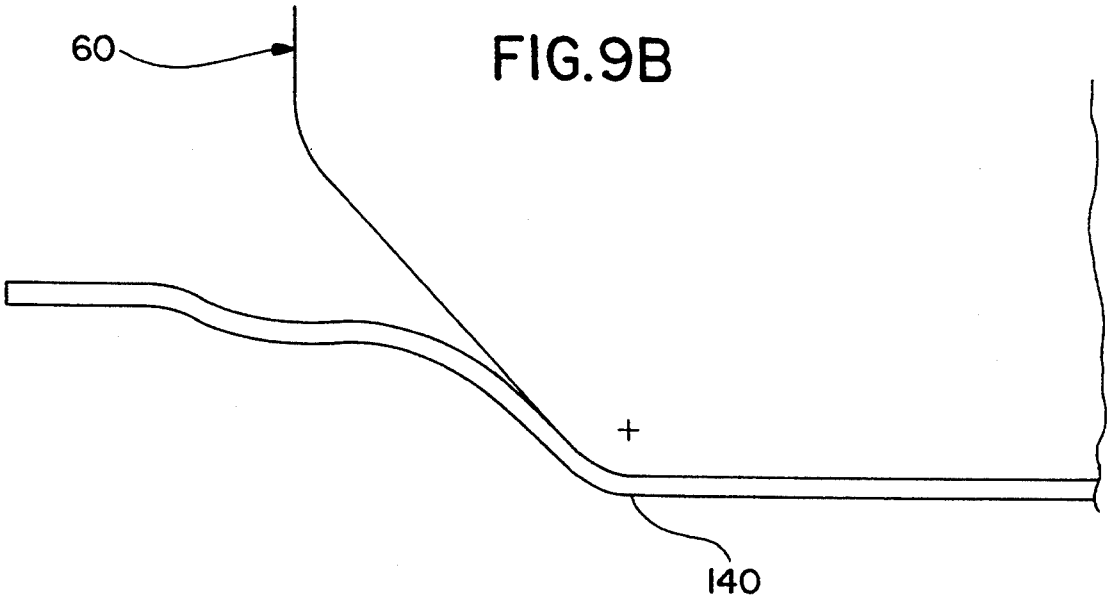
FIG. 9*b* is the section view of FIG. 9*a* with the eccentric roll in the misaligned position.

In order to substantially reduce the occurrence of krinkling of the container sidewall 16, it has been found beneficial to create tension in the container sidewall 16 prior to engagement of the container body 10 by the form roll 80 (i.e., induce "pre-tension"). In this regard, the present embodiment creates such pre-tension in the container sidewall 16 by creating an interference between the shoulder-forming radius 76 of the eccentric roll 60 and the die-necked shoulder radius 34 of the container body 10 presented to the spin-flow forming apparatus 50. More specifically, when the eccentric roll 60 is axially positioned within the container body 10 prior to the spin flow forming operation, the axial distance $D_2$ is larger than the axial distance $D_1$. That is, the shoulder-forming radius 76 of the eccentric roll 60 is axially positioned closer to the open end 12 of the container than the die-necked shoulder radius 34 of the container body 10 by an interference I, as shown in FIG. 9*a*. Consequently, when the eccentric roll 60 is moved from the aligned position to the misaligned position, the eccentric roll 60 will contact the shoulder portion 32 of the container body 10 and deflect at least part of the shoulder portion 32 radially outward, as shown in FIG. 9*b*.

At least a portion of the radially outward deformation of the shoulder portion 32 is caused by the angled portion 74 of the eccentric roll 60. As such, it can be appreciated that such radially outward deformation will tend to create pretension in the sidewall 16 of the container body 10 prior to actuation of the form roll 80. It is this pre-tension in the sidewall 16 which is believed to substantially reduce the occurrence of krinkling which has been observed during the interference spin-flow forming operation. After the eccentric roll 60 is moved to the misaligned position to create pretension in the container sidewall 16, the form roll 80 is radially advanced to further neck the open end 12 of the container in a manner similar to that described above for the aligned spin-flow forming operation.

The above-described interference between the eccentric roll 60 and the container body 10 can be accomplished in a variety of ways. For example, for a given die-necked container body 10, the eccentric roll 60 can merely be positioned a shorter distance into the open end 12 of the container body 10 compared to the positioning of the eccentric roll 60 for an aligned spin-flow forming operation. However, it can be appreciated that this would create a container body 10 having a shoulder radius 34 positioned axially further from the container bottom 14 than the corresponding aligned spinflow forming operation. Therefore, when utilizing the interference spin-flow forming operation, in order to create a shoulder radius 34 at a given distance from the container bottom 14, the shoulder radius 34 formed by the previous die-necking operation must be axially closer to the container bottom 14 than is the desired final shoulder radius 140. The eccentric roll 60 is then axially positioned relative to the container bottom 14 such that the shoulder-forming radius 76 of the eccentric roll 60 is approximately positioned at the location where the final shoulder radius 140 of the container body 10 is desired.

In the described embodiment, the preferred amount of interference I between the eccentric roll 60 and the container body 10 (i.e., the difference between the axial distance between the shoulder-forming radius 76 and the container bottom 14 and the axial distance between the die-necked shoulder radius 34 and the container bottom 14) can vary depending on a number of factors, such as sidewall thickness, container body material, forming radii, and other variables. In the described embodiment, wherein the material is aluminum and the dimensions are as described above, the interference I can be between about 0.010 inches and about 0.150 inches. Preferably, such interference is between about 0.050 inches and about 0.110 inches and, more preferably, is about 0.080 inches.

In operation, the interference spin-flow forming operation is initiated by loading a die-necked container body 10 onto the base pad assembly 120. Such container body 10 has a shoulder radius 34 positioned at a first axial distance $D_1$from the container bottom 14. The base pad assembly 120 and forming rolls are then axially advanced toward each other until the shoulder-forming radius 76 of the eccentric roll 60 is axially positioned at a second axial distance $D_2$ from the container bottom 14 (i.e., at approximately the location of the desired final shoulder radius 140), the second axial distance D2 being greater than the first axial distance Dlo With the container body 10 spinning, the eccentric roll 60 is moved from the aligned position (FIG. 9*a*) to the misaligned position (FIG. 9*b*) to force at least a part of the shoulder portion 32 of the container body 10 radially outward, thereby creating pre-tension in the container sidewall 16. The form roll 80 is subsequently radially advanced to further reduce the open end 12 of the container, as described above for the aligned spin-flow forming operation.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A method of necking a cylindrical metal container body having a sidewall, said method comprising the steps of:

reducing a first portion of the sidewall to a first necked diameter, wherein a shoulder portion is formed connecting a second, unreduced portion of the sidewall to the first portion;

applying a force to create tension in at least a portion of the second portion; and further reducing at least a portion of the first portion to a second necked diameter, during at least a portion of said applying step, by effecting relative motion between the container body and at least one external forming member.

2. A method, as set forth in claim 1, wherein said step of reducing a first portion of the sidewall comprises:

performing at least one die-necking operation.

3. A method, as set forth in claim 2, wherein said step of performing at least one die-necking operation comprises:

performing at least three die-necking operations.

4. A method, as set forth in claim 2, wherein said step of performing at least one die-necking operation comprises:

axially aligning an open end of the container body with a die set having an external necking die and an opposing internal pilot; and forcing the open end between the external necking die and the opposing internal pilot to reduce the first portion of the sidewall and to form the shoulder portion.

5. A method, as set forth in claim 1, wherein said step of applying a force to create tension comprises:

radially displacing at least part of the shoulder portion outwardly away from the central longitudinal axis.

6. A method, as set forth in claim 5, wherein said shoulder portion includes a shoulder radius longitudinally positioned at a first longitudinal distance from a container bottom, and wherein said step of radially displacing at least part of the shoulder portion comprises:

positioning a first rotatable support member, having a forming radius, inside the container body with the forming radius longitudinally positioned at a second longitudinal distance from the container bottom, the second longitudinal distance being greater than the first longitudinal distance; and advancing the first support member radially outwardly away from the central longitudinal axis of the container body until at least a portion of the shoulder portion is displaced radially outwardly.

7. A method, as set forth in claim 6, wherein the first support member is eccentrically rotatably mounted to an eccentric shaft, wherein the eccentric shaft is rotatable about its central axis which is eccentrically positioned relative to the central longitudinal axis of the container body, and wherein said step of advancing the first support member comprises:

rotating the eccentric shaft to move the first support member away from the central longitudinal axis of the container body.

8. A method, as set forth in claim 6, wherein a difference between the first longitudinal distance and the second longitudinal distance is between about 0.010 inches and about 0.150 inches.

9. A method, as set forth in claim 8, wherein the difference between the first longitudinal distance and the second longitudinal distance is between about 0.050 inches and about 0.110 inches.

10. A method, as set forth in claim 9, wherein the difference between the first longitudinal distance and the second longitudinal distance is about 0.080 inches.

11. A method, as set forth in claim 1, wherein said step of further reducing at least a portion of the first portion comprises:

performing a spin-flow necking operation on the sidewall to reduce the first portion to the second necked diameter.

12. A method, as set forth in claim 11, wherein the external forming member comprises at least one external roller, and wherein said step of performing a spin-flow necking operation comprises:

spinning the container body about a central longitudinal axis;

positioning a first rotatable support member inside the container body;

positioning a second rotatable support member inside the container body adjacent an open end;

radially advancing the external roller inwardly toward a central longitudinal axis of the container body; and continuing to radially advance the external roller inwardly toward the central longitudinal axis of the container, wherein an angled first face of the external roller cams radially and axially against a complementarily angled face of the first support member toward the open end to reduce the first necked diameter of the open end to the second necked diameter.

13. A method, as set forth in claim 12, wherein said step of continuing to radially advance the external roller reforms at least a portion of the shoulder portion.

14. A method, as set forth in claim 13, wherein said shoulder portion includes a shoulder radius, and wherein said step of continuing to radially advance the external roller reforms the shoulder radius to a reformed radius smaller than the shoulder radius.

15. A method, as set forth in claim 12, wherein said step of spinning the container body occurs before said step of applying a force to create tension.

16. A method of necking an open end of a cylindrical metal container body having a sidewall, said method comprising the steps of:

performing at least one die-necking operation to reduce the open end to a first necked diameter and to form a shoulder portion connecting an unreduced portion to the open end, said die-necking operation comprising:

axially aligning the open end with a die set having an external necking die and an opposing internal pilot; and forcing the open end between the external necking die and opposing internal pilot to reduce the open end, wherein the formed shoulder portion includes a shoulder radius longitudinally positioned at a first longitudinal distance from a bottom of the metal container;

performing a spin-flow necking operation on the open end to reduce the open end to a second necked diameter, said spin-flow necking operation comprising:

positioning a first rotatable support member, having a forming radius, inside the container with the forming radius longitudinally positioned at a second longitudinal distance from the bottom of the metal container, the second longitudinal distance being greater than the first longitudinal distance;

positioning a second rotatable support member inside the container adjacent the open end;

spinning the metal container about a longitudinal axis;

advancing the first support member outwardly away from the longitudinal axis until at least a portion of the shoulder portion of the container is displaced radially outwardly;

radially advancing an external roller inwardly toward the longitudinal axis; and continuing to radially advance the external roller inwardly toward the longitudinal axis, wherein an angled first face of the external roller cams radially and axially against a complementarily angled face of the first support member towards the open end to reduce the open end to the second necked diameter.

* * * * *